US009366426B2

(12) United States Patent
Popp et al.

(10) Patent No.: US 9,366,426 B2
(45) Date of Patent: Jun. 14, 2016

(54) LANCE FOR REMOVING DEPOSITS ADHERING TO THE TUBE SHEET OF A STEAM GENERATOR

(71) Applicant: AREVA GmbH, Erlangen (DE)

(72) Inventors: Sebastian Popp, Emskirchen (DE); Johannes Stoss, Fürth (DE); Renate Kilian, Fürth (DE); Franz Strohmer, Bamberg (DE)

(73) Assignee: AREVA GMBH, Erlangen (DE)

( * ) Notice: Subject to any disclaimer, the term of this patent is extended or adjusted under 35 U.S.C. 154(b) by 0 days.

(21) Appl. No.: 14/765,264

(22) PCT Filed: Feb. 19, 2014

(86) PCT No.: PCT/EP2014/053241

§ 371 (c)(1),
(2) Date: Jul. 31, 2015

(87) PCT Pub. No.: WO2014/128166

PCT Pub. Date: Aug. 28, 2014

(65) Prior Publication Data

US 2015/0369472 A1 Dec. 24, 2015

(30) Foreign Application Priority Data

Feb. 20, 2013 (DE) ..... 10 2013 101 656

(51) Int. Cl.
*F22G 7/00* (2006.01)
*F22B 37/48* (2006.01)

(52) U.S. Cl.
CPC ..... *F22B 37/483* (2013.01)

(58) Field of Classification Search
CPC ..... F28G 3/166; F22B 37/486
USPC ..... 122/379
See application file for complete search history.

(56) References Cited

U.S. PATENT DOCUMENTS 4,424,769 A * 1/1984 Charamathieu ..... F28G 15/04 122/391
4,827,953 A * 5/1989 Lee ..... F28G 15/04 122/392

(Continued)

FOREIGN PATENT DOCUMENTS

BE 900.716 A2 2/1985
DE 31 26 169 A1 3/1982

(Continued)

OTHER PUBLICATIONS

International Application No. PCT/EP2014/053241 International Preliminary Report on Patentability Dated Aug. 25, 2015 (5 Pages).

*Primary Examiner* — Gregory A Wilson
(74) *Attorney, Agent, or Firm* — Keller Jolley Preece

(57) ABSTRACT

The invention relates to a lance for removing deposits adhering to the tube sheet of a steam generator, comprising a flexible strip which is introducing into intermediate tube areas of the steam generator, which has a cleaning head at the free end of the strip, and which comprises at least one water hose that is used to supply a flow of water to the cleaning head. In a use situation, the cleaning head comprises a working face which faces the tube sheet or deposits present thereon, an outlet opening which is fluidically connected to the water hose and opens into the working face, and a mechanical tool which acts on the deposits and removes material.

32 Claims, 9 Drawing Sheets

(56) References Cited

U.S. PATENT DOCUMENTS 5,022,463 A * 6/1991 Boisture ..... B65H 75/4402 122/379
5,036,871 A * 8/1991 Ruggieri ..... F22B 37/483 134/167 R
5,065,703 A * 11/1991 Lee ..... F28G 15/04 122/379
5,341,406 A * 8/1994 Jens ..... B25J 18/06 122/392
5,615,734 A * 4/1997 Hyp ..... F22B 37/002 165/11.2
5,782,209 A * 7/1998 Vandenberg ..... F22B 37/483 122/379
5,925,193 A * 7/1999 Bude ..... F23J 3/00 134/167 R
6,035,811 A * 3/2000 Bude ..... F23J 3/00 122/390
6,073,641 A * 6/2000 Bude ..... F28G 3/166 122/379
6,101,985 A * 8/2000 Bude ..... F23J 3/00 122/379
6,192,904 B1 * 2/2001 Secknus ..... F22B 37/483 122/392
6,513,462 B1 * 2/2003 Shiraishi ..... B08B 3/102 122/382
6,672,257 B1 * 1/2004 Ashton, III ..... F22B 37/483 122/379
2004/0083986 A1 5/2004 Ashton, III et al.

FOREIGN PATENT DOCUMENTS

DE 40 39 376 A1 6/1991
DE 100 06 066 A1 8/2001
DE 201 22 403 U1 11/2005
DE 10 2010 039 413 A1 2/2012
WO 90/07679 A1 7/1990
WO 2008/005870 A2 1/2008

* cited by examiner

LANCE FOR REMOVING DEPOSITS ADHERING TO THE TUBE SHEET OF A STEAM GENERATOR

CROSS-REFERENCE TO RELATED APPLICATIONS

This application is a national phase entry under 35 U.S.C. §371 of International Application No. PCT/EP2014/053241, filed Feb. 19, 2014, which claims the benefit of German Application No. 10 2013 101 656.1, filed Feb. 20, 2013. The entire contents of each of the foregoing patent applications are hereby incorporated by reference.

BACKGROUND OF THE INVENTION

1. Field of the Invention

The invention relates to a lance for removing deposits adhering to the tube sheet of a steam generator.

2. Background and Relevant Art

Deposits which become hard over time during operation and consist of corrosion products are formed on the tube sheet plate of steam generators in nuclear or conventional power stations. After prolonged operation or if cleaning has not been carried out for a prolonged period, said deposits may become very hard. Very hard deposits may also arise if, in addition to the corrosion products, silicates or alumino-silicates from the secondary circuit are involved in the formation thereof.

Deposits on the tube sheet may cause long term damage to the steam generator by, for example, constricting the steam generator tubes or heating tubes extending away from the tube sheet. The complete removal of hard deposits from the surface of the tube sheet is therefore necessary in order to prevent damage to the steam generator in the long term. This is customarily carried out by high-pressure spraying with water by means of lances which are introduced into the bank of tubes of the steam generator. However, with this known method which is known in the art as inner bundle lancing (IBL) and is known, for example, from DE 100 06 0667 A1, DE 40 39 376 A1 and U.S. Pat. No. 4,424,769 and which operates with water pressures of up to approximately 220 bar, older deposits, deposit bridges between the heating tubes, and silicate-containing deposits of highly compact structure are hardly removed. In these cases, the water jet rebounds or is simply merely deflected, and therefore at most a merely minimal cleaning effect can be obtained. There is currently also no chemical method with which the abovementioned silicate-deposits can be dissolved.

BRIEF SUMMARY OF THE INVENTION

It is the object of the invention to propose a lance of the type mentioned at the beginning, with which deposit of the abovementioned type can be removed from the tube sheet.

This object is achieved with a lance as claimed in claim 1. The lance comprises a flexible strip which serves for introducing into intermediate spaces between the tubes of the steam generator, bears a cleaning head at the free end thereof and bears at least one water hose serving for supplying a flow of water to the cleaning head. The cleaning head has a working side which, in the use situation, faces the tube sheet or deposits present there, an outlet opening which is fluidically connected to the water hose and opens into the working side, and a mechanical tool which acts on the deposits and removes material. Such a lance therefore combines a hydraulically working and a mechanically working removal technique. The effect arises here that, with the mechanical tool, parts of the deposits can be detached and washed away by the water jet leaving the outlet opening, and therefore the mechanical tool can act on the deposits in a manner unhindered by material which has already been removed. The lance can be used particularly effectively if the operation is carried out at high water pressures of, for example, up to 220 bar and more. While, in the case of conventional high-pressure water-spraying methods, the water jet is repeatedly deflected only at the deposits because of the lack of engagement surfaces, with a lance according to the invention such engagement surfaces can be provided with the aid of the mechanical tool by, for example, grooves being introduced into the deposits, on the groove walls of which the water jet can act with the kinetic energy inherent thereto.

The mechanical tool can be fixedly connected to the cleaning head, wherein a tool movement bringing about a removal of material can be caused indirectly by a movement of the cleaning head. However, a mechanical driving means which is supplied to the cleaning head via the flexible strip of the lance, for example a cable pull, with which the tool can be set into movement, is also conceivable.

However, in a particularly advantageous variant embodiment, it is provided to use the water jet supply to the cleaning head in a further function for the purpose of indirectly or directly driving the tool, wherein a drive which is simple in terms of production and installation is ensured if a rotating tool is used, for example a tool having an axis of rotation that runs transversely with respect to the central flat plane of the cleaning head. In such an embodiment, approximately disk-shaped tools can easily be accommodated in the cleaning head which, because of the narrow intermediate spaces between the tubes, has a correspondingly small width.

In particular in the event of an indirect or direct drive of the tool, it is expedient if the cleaning head has a cavity into which the water hose opens, wherein the cavity is connected to the environment via the abovementioned outlet opening. The cavity can serve, for example, for receiving the tool or a driving element for the tool, for example a water wheel.

In terms of production and installation, it is advantageous, in case of a direct drive, if said drive occurs with the aid of impact surfaces which are acted upon by the flow of water supplied to the cleaning head. An effectively working and at the same time technically simple tool is a rotating milling disk, over the circumferential surface of which a multiplicity of material-removing elements is distributed. For the rotational drive of the milling disk, impeller- or blade-wheel-like structures can be attached to the side surfaces thereof, said structures having impact surfaces interacting with the water jet.

However, in a particularly preferred variant embodiment, the impact surfaces are present on the material-removing elements, that is to say, part of the surface of said elements forms an impact surface which is acted upon by the water jet. The material-removing elements therefore carry out a dual function, which in particular simplifies production and installation, by said elements serving both for the drive and for removing the deposits. Furthermore, said elements generate a pulsating water jet, resulting in a further increase of the cleaning effect. The pulsation frequency of the water jet is dependent on the flow velocity of the flow of water, the diameter of the milling disk and the number of material-removing elements or teeth present thereon. With such a refinement, it is possible in a simple manner to increase and to regulate the rotational speed of the milling disk and therefore the impact frequency of the teeth interacting with a deposit, by the water jet volume acting upon the milling disk being varied, for example increased. Of course, a change in the rotational speed in the manner mentioned is also possible in the case of the abovementioned water wheel. When the water jet strikes against the milling disk, said water jet is divided into a multiplicity of water drops, wherein the pulsation frequency of the water drop impact arising in the process can be adjusted, apart from by changing the volume of the flow of water, also by varying the number of teeth or the number of material-removing elements of the milling disk. Depending on the hardness of the deposit to be removed, a change in the impact force of the teeth or material-removing elements acting on the deposits may be expedient, wherein this can take place by a corresponding adjustment of the water pressure or of the pressure of the water jet striking against the milling disk.

In order to ensure an effective drive of a milling disk by means of the flow of water, said milling disk is oriented in such a manner that it is acted upon in the tangential direction at least by a partial flow of the flow of water. The effectiveness of the drive and the generation of a water jet directed onto deposits is optimized by the tool being at least partially arranged in a cavity present within the cleaning head, wherein at least one water hose opens into the cavity and is connected to the atmosphere via the outlet opening.

The outlet opening from which the water supply to the cleaning head emerges in the form of at least one water jet acting upon the deposits can be arranged at different positions on the cleaning head. However, an effective removal of deposits can be achieved if a part of the tool that acts in a material-removing manner, a disk element in the case of a milling disk, projects out of the outlet opening. Both in the case of a rotating tool and in the case of a tool moving in another manner, for example linearly, damage, for example, to the tube sheet is prevented by the tool not protruding beyond the working side of the cleaning head.

A further possibility of accommodating an effectively working tool, which is driven directly by the flow of water, with little space being required in a cleaning head arises, in a further variant embodiment, by the fact that the axis of rotation of the tool runs parallel to the central flat plane of the cleaning head. Cylindrical tools are suitable which are designed, for example, in a manner of core drills having a comparatively small outside diameter. Material-removing elements can be present on an end surface of the tool, which end surface runs transversely with respect to the axis of rotation, and/or on a circumferential surface of the tool, which circumferential surface runs in the direction of rotation or coaxially with respect to the axis of rotation.

In the case of this variant embodiment, the tool also has at least one impact surface which is acted upon by the flow of water, wherein said impact surface runs substantially along the axis of rotation of the tool and inclined to a plane containing the axis of rotation. When the flow of water strikes against the impact surface, the latter is subjected to a rotational force. A refinement of the type under discussion can be realized in a particularly simple manner by the at least one impact surface being formed by a groove wall of a flow groove introduced into the circumferential surface of the tool. The tool can be positioned on the cleaning head in such a manner that a flow of water leaving a water hose can enter the flow groove. The effectiveness of the drive can be increased by the flow groove being contracted in the direction of flow of the flow of water.

In a particularly preferred exemplary embodiment, the tool is rotatable in an outlet opening of the cleaning head, which outlet opening is designed as a bore.

In a further variant embodiment, the tool is indirectly driven by the flow of water. The flow of water supplied to the cleaning head therefore does not strike against the tool, or at least does not strike there against for the purpose of driving, and therefore further refinement possibilities for the cleaning head and a cleaning method carried out therewith are produced. Thus, as is the case in a preferred exemplary embodiment, a linear movement of the tool, which is designed, for example, as a scraping tool, can be performed with the aid of a water wheel which is driven by the flow of water and is connected via a gear mechanism, in particular a crank mechanism, to the tool. It is particularly advantageous in the case of a lance, the advancing and withdrawing direction of which runs parallel to the tube sheet in the use situation, if the linear movement of the tool extends in the longitudinal direction of the lance.

As in the case of the abovementioned milling disk, it is also expedient, in the case of a water wheel, if the latter is oriented in such a manner that it is acted upon in the tangential direction at least by a partial flow of the flow of water. The water wheel is likewise arranged in a cavity present within the cleaning head, wherein at least one water hose opens into the cavity and the latter is connected to the atmosphere via an outlet opening. However, unlike in the case of a milling disk, it is not necessary for the water wheel to project beyond the outlet opening. On the contrary, it is expedient if said water wheel is arranged completely within the cavity.

In a preferred variant embodiment, the tool is fixed to a linearly movable support. This has the advantage that shape and material of the tool are freely selectable without consideration of the corresponding requirements for a connection in terms of drive to the water wheel. The support is preferably guided in a guide channel which is connected to the cavity and opens into the atmosphere, wherein the tool is arranged on a section of the support, which section projects out of the cleaning head. The tool, which is designed, for example, as a pin- or rod-shaped scraping tool, protrudes from the support and extends therefrom toward the working side of the cleaning head.

So that a material-removing tool can work effectively, said tool has to be pressed with a certain force against the tube sheet or the deposits present there. In a preferred variant embodiment, this is assisted by at least one outlet bore through which a partial flow of the flow of water supplied to the cleaning head via the water hose is conducted away into the environment. The outlet bore can serve, for example, as a pressure relief bore for a receiving space which is arranged in the cleaning head and receives, for example, a tool. In particular, however, an outlet bore can be arranged in such a manner that a water jet emerging from said outlet bore generates a recoil which presses the cleaning head against the deposit to be removed or generate a counterpulse to the pulse caused by a flow of water emerging from the outlet opening. An outlet bore serving for this purpose preferably opens onto a cleaning head side opposite the working side.

BRIEF DESCRIPTION OF THE DRAWINGS

The invention is now explained in more detail with reference to the attached drawings, in which.

DETAILED DESCRIPTION

Figure 1:
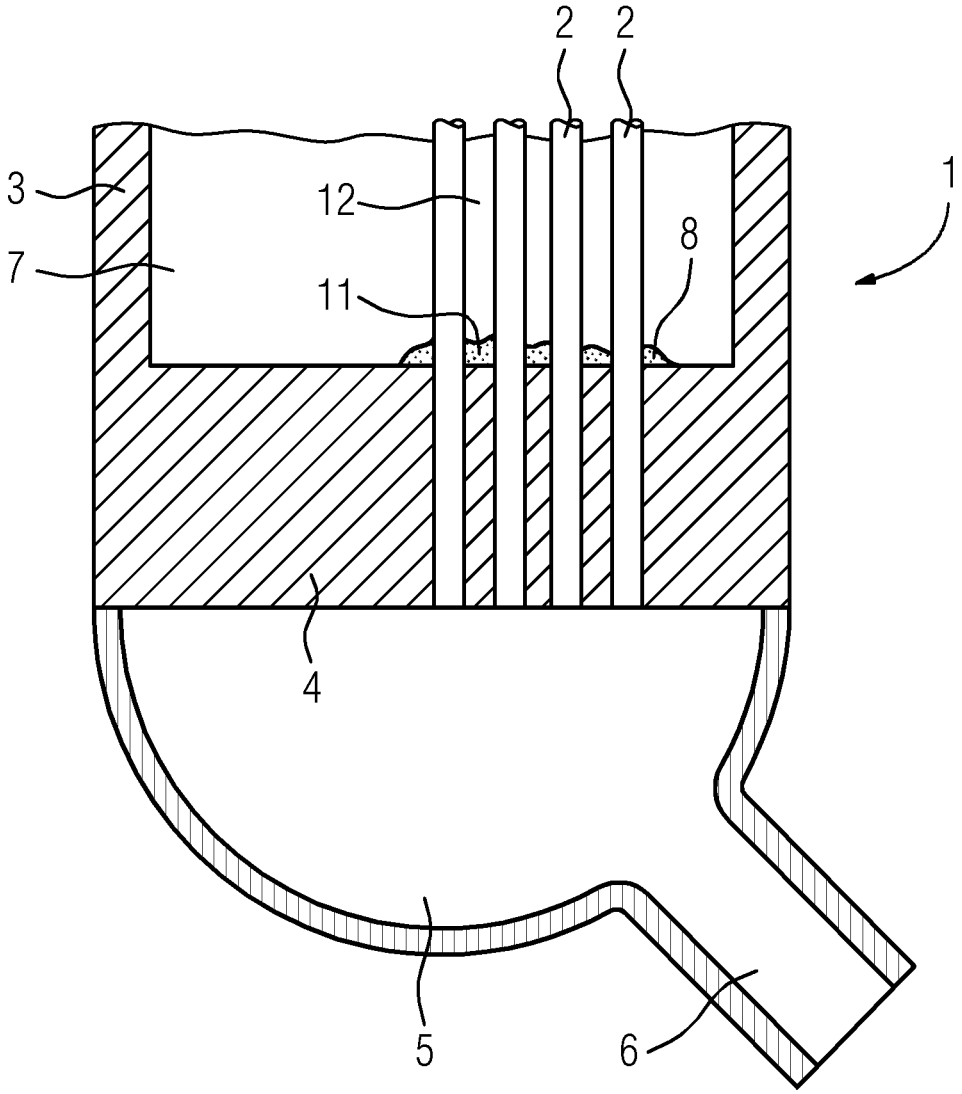
FIG. 1 shows a schematized longitudinal section through a lower part of a steam generator.

A steam generator 1 to be cleaned with a lance according to the invention comprises a multiplicity of heating tubes 2 which are bent in a U-shaped manner, are arranged in the secondary side of the steam generator, and the ends of which are passed through a bottom of the steam generator housing 3, a what is referred to as tube sheet 4, and open out into the primary side 5 of the steam generator 1. The primary side 5 of the steam generator has an inlet 6 via which primary coolant flows into the steam generator 1. The primary side 5 is divided into two partial spaces by a partition (not shown), wherein the ends of the heating tubes 2 bent in a U-shaped manner open into the one partial space and the respectively other ends open into the other partial space of the primary side 5. The primary coolant leaves the steam generator via an outlet (not shown in FIG. 1).

During operation, deposits 8 are formed on that side of the tube sheet 4 which is connected to the secondary side 7 of the steam generator 1, wherein said deposits extend in the form of what are referred to as bridges 11 into intermediate spaces 12 between the tubes.

Figure 3:
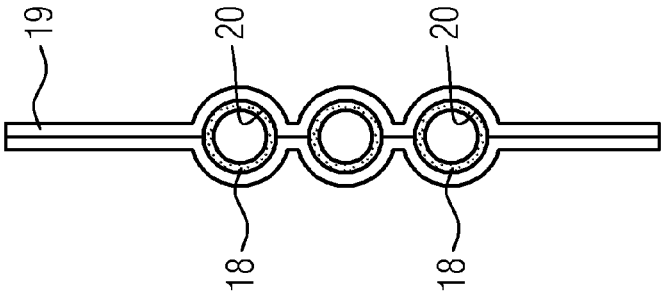
FIG. 3 shows a cross section through a flexible strip.

A lance 13 comprises a flexible strip 14 which is intended for introducing into intermediate spaces 12 between the tubes and which bears a cleaning head 15 at the free end thereof. The free end of the flexible strip 14 is the end which, in the use situation, i.e. during the cleaning of a steam generator tube sheet 4, is introduced into an intermediate space 12 between the tubes or into a gap between the tubes. The strip 14 has a row of uniformly spaced-apart apertures 17 in the edge region, the row extending in the longitudinal direction 16 of said strip. Said apertures serve for the advance and retraction of the lance 13. For the purpose of supplying a flow of water to the cleaning head 15, the strip 14 comprises three water hoses, or put in general, lines, extending in the longitudinal direction 16. As can be seen in FIG. 3, said water hoses are arranged, for example, between two thin material strips 19, for example composed of steel, which substantially form the flexible strip 14. Flutes 20 which enclose the water hoses 18 therebetween are formed here in the material strips 19 from the inner side thereof. Of course, the flexible strip 14 bearing the water hoses 18 can also be formed in any other manner and can bear a different number of water hoses.

A mechanical tool 21*a*, 21*b*, 21*c* which acts on the deposits 8 and removes material is arranged in the cleaning head 15. In the variant embodiment illustrated, the tool is movable and is driven by a drive, wherein the tool is driven by the flow of water either directly or indirectly, i.e. via the connection of a gearing.

Figure 2:
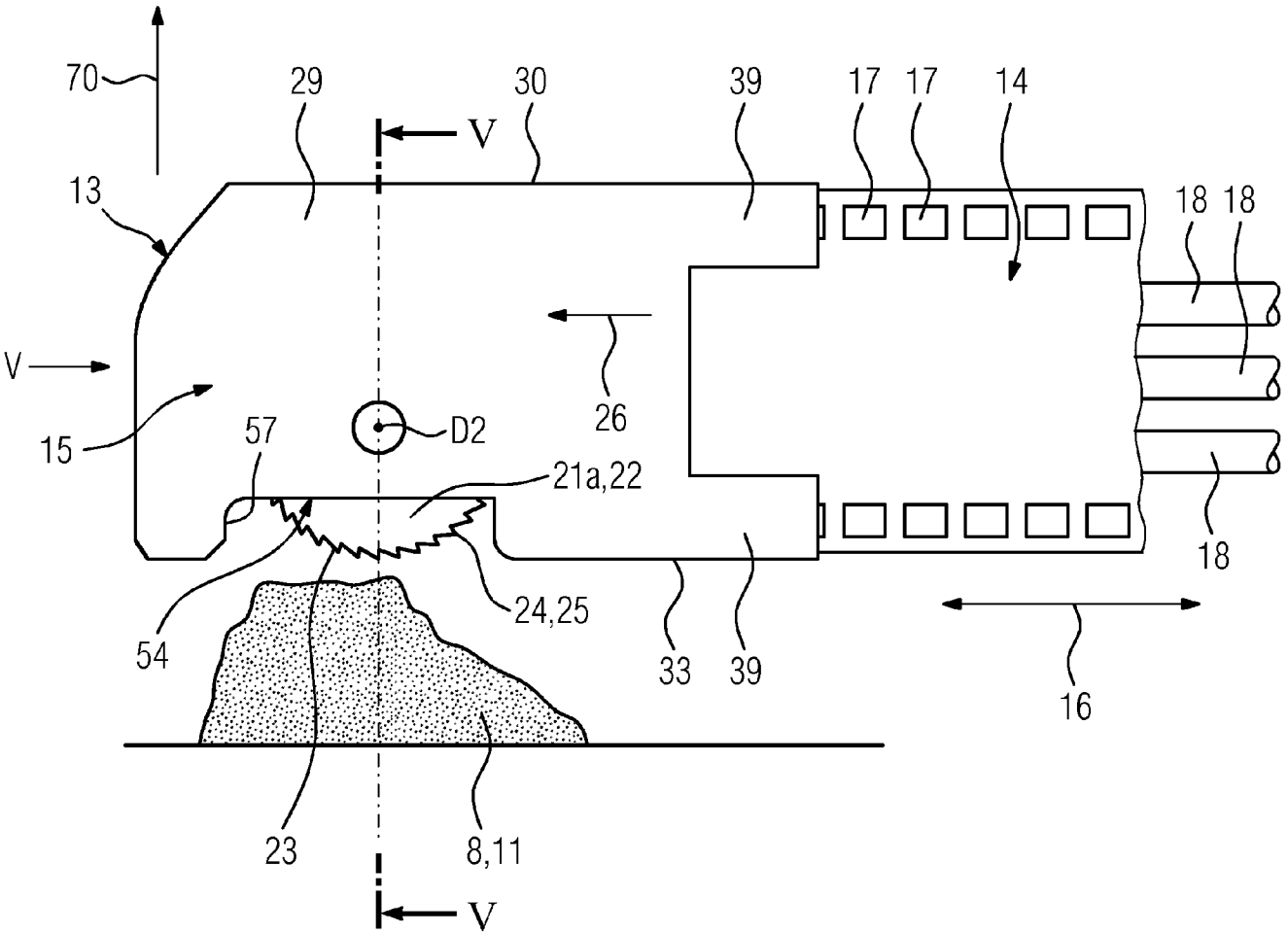
FIG. 2 shows a side view of the front end of a lance according to a first variant embodiment, the end bearing a cleaning head.
Figure 4:
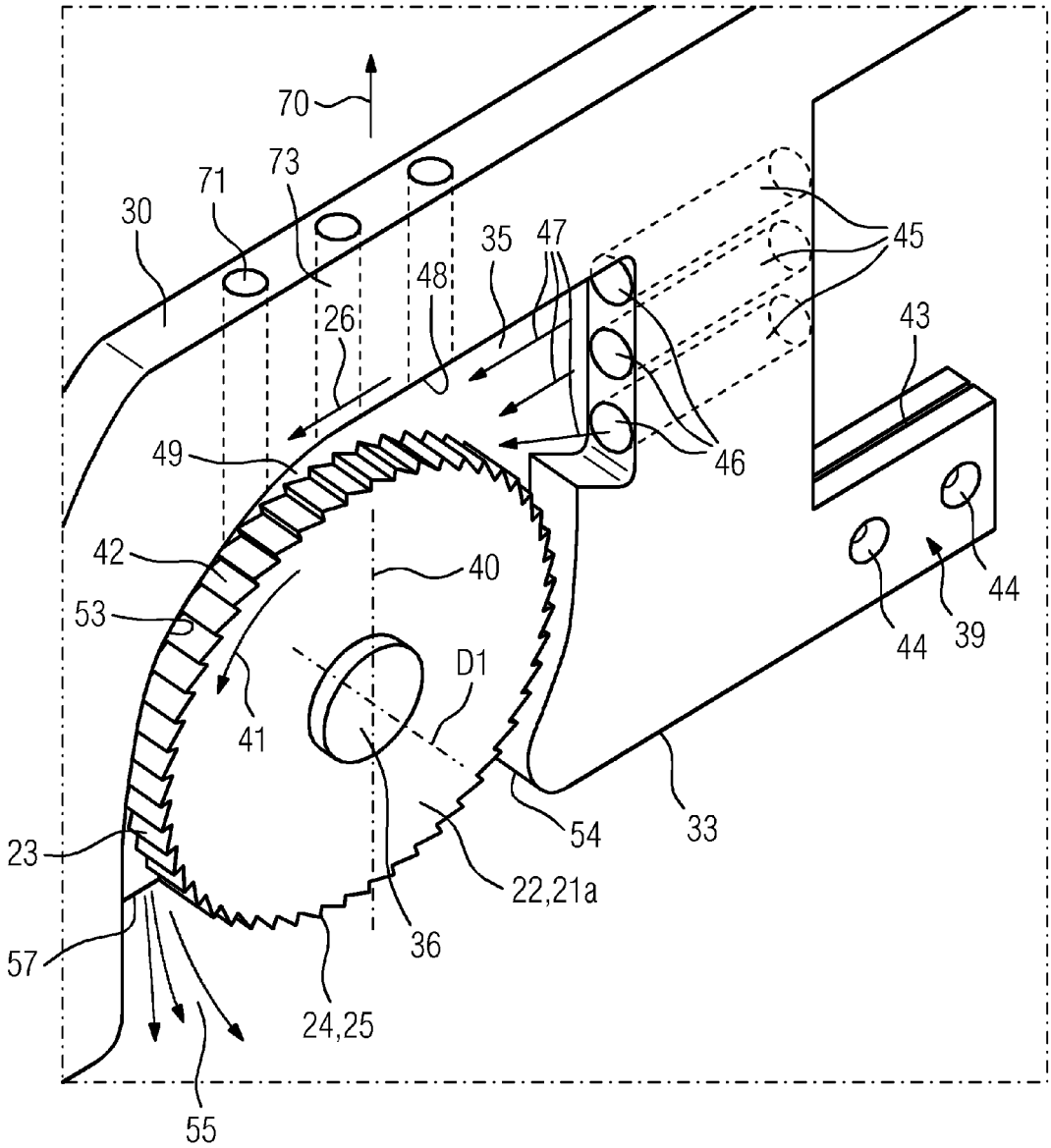
FIG. 4 shows a partial perspective illustration of the cleaning head, wherein the latter is opened laterally in order to open up the view to the interior thereof.

A first variant embodiment of a lance 13, which has a direct flow of water drive, is shown in FIGS. 1, 2 and 4 to 6. The tool 21*a* is arranged here in such a manner that the axis of rotation D1 thereof runs transversely with respect to the central flat plane P of the cleaning head 15. The tool is designed as a milling disk 22, the circumferential surface 23 of which bears a multiplicity of material-removing elements 24 (FIGS. 2, 4). In the exemplary embodiment illustrated, the milling disk is designed as a gearwheel, wherein the teeth 25 thereof form the material-removing elements 24. Those flanks of the teeth 25 which face counter to the direction of rotation 41 form impact surfaces 42 which are acted upon by the flow of water. The milling disk 22 is arranged on or in the cleaning head 15 in such a manner that it is acted upon in the tangential direction 26 at least by a partial flow of the flow of water supplied to the cleaning head.

Figure 5:
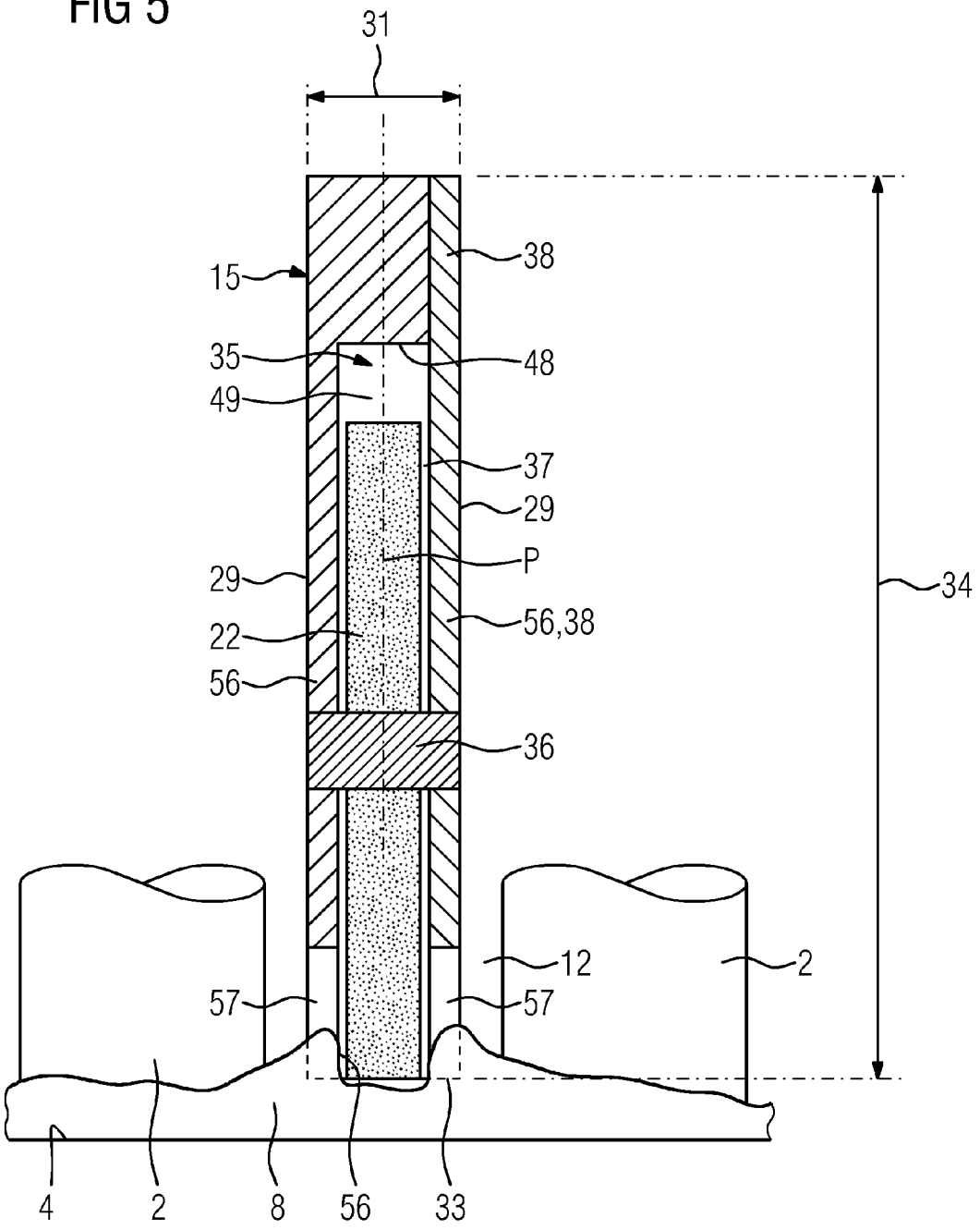
FIG. 5 shows a cross section of a cleaning head corresponding to line V-V in FIG. 2.
Figure 6:
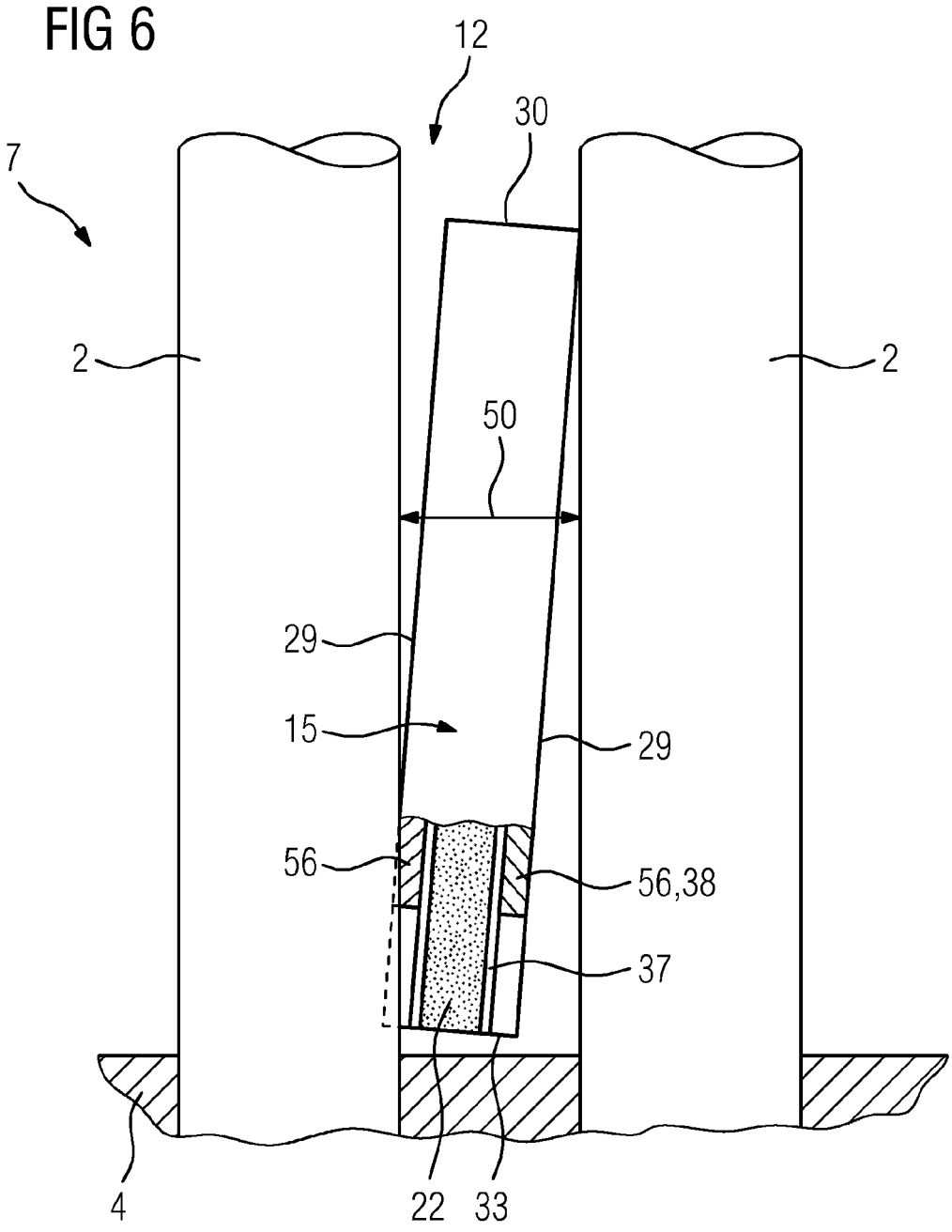
FIG. 6 shows a schematic figure which illustrates a cleaning head looking in the direction of the arrow V in FIG. 2, in a laterally tilted position in an intermediate space between the tubes.

Within the cleaning head 15, the latter, as seen in top view from the front in the direction of the arrow V in FIG. 2 or in the cross section according to FIG. 5, is of substantially rectangular configuration. The cleaning head has two flat sides 29 which, in the use situation, extend approximately parallel to the longitudinal extent of the heating tubes 2. The upper side 30 of the cleaning head and the lower side, which is referred to below as the working side 33, extend by contrast transversely with respect to the longitudinal extent of the heating tube. The height 34 of the cleaning head 15 is substantially greater than the width 31 thereof.

Within the cleaning head 15 there is a cavity 35 in which the milling disk 22 is arranged. For the rotatable fixing of the milling disk, the latter is penetrated by a spindle 36 which is mounted at the ends thereof protruding from the milling disk 22 on the milling head 15. There is a gap 37 between the milling disk 22 and the inner wall of the cavity 35 in order to ensure that the milling disk runs smoothly. The receiving space 35 is open toward a flat side 29 and, in the installed state, is closed laterally by a closure element, for example a side plate 38.

The cleaning head 15 has, on the rear side thereof, two limbs 39 which are spaced apart in the vertical direction and are penetrated in the vertical direction by a receiving slot 43 (FIG. 4). The elastic strip 14 is inserted at the front end thereof into the latter. In order to fix the strip 14 in the longitudinal direction 16 on the head 15, two bores 44 reach through both of the limbs 39, into which bores a respective fastener (not illustrated), which passes through an aperture 17 in the strip 14, can be introduced.

The water hoses 18 are connected to the cavity 35 via connecting channels 45. The latter open by means of nozzle openings 46 into the cavity 35. The connecting channels 45 and the nozzle openings 46 are arranged and oriented in such a manner that a flow of water or water jet, indicated by the arrows 47 in FIG. 4, strikes against the teeth 25 of the milling disk 22 at least approximately in the tangential direction 26. In order to assist a tangential guidance of the flow, the upper wall 48 close to the upper side 30 of the cleaning head runs approximately as far as the center of the milling wheel 22 or approximately as far as an imaginary line 40, which extends in the vertical direction and intersects the spindle 36, in the tangential direction 26. The water ejected by the nozzle openings 46 flows through the space 49, which is bounded on the top side and bottom side by the wall 48 and the milling wheel 22 and acts in the manner of a throttle point, and is accelerated in the process. The wall 48, following the region thereof running rectilinearly in the longitudinal direction 16, approximately follows the circular shape of the milling disk 23 by means of a curved section 53.

The cavity 35 opens by means of an outlet opening 54 into the working side 33 of the cleaning head 15. The water supplied to the cleaning head 15 therefore leaves the latter via the outlet opening 54, to be precise substantially via a space present between the wall 48 and the front side of the milling disk 22, which front side faces away from the flexible strip 14, as has been indicated in FIG. 4 by means of the arrows 55. Owing to the toothing of the milling disk 22, the water jet emerging via the outlet opening 54 is pulsed. On account of the emerging water jet being directly adjacent to the region of action of the milling disk 22, particles of the deposits 8 that are removed by said water jet are immediately washed away. As can be gathered from FIG. 5, the deposit 8 can partially be removed with the aid of the milling disk 22, wherein, for example, a flute or a groove 56 which provides engagement surfaces for the water jet 54 emerging from the outlet opening 54 is formed. The breaking up of the deposits with a high-pressure water jet is thereby assisted.

In order to avoid damage to the tube sheet 4, the milling disk 22 does not protrude at any point beyond the working side 33 of the cleaning head 15. This is achieved by the fact that side walls 56 (FIG. 5), which delimit the cavity 35 and form the flat sides 29, have a recess 57 bulging out toward the upper side 30 in the region of the outlet opening 54 and the milling disk 22. As can be seen in FIG. 5, a deposit 8 or bridge 11 present on the tube sheet 4 can therefore extend into said recess 57 and can consequently be acted upon by the milling disk 22 for the introduction of a groove 56. Damage to a heating tube 2 by the milling disk 22 is avoided by the fact that the height 34 and width 35 of the cleaning head are selected in such a manner that, at a predetermined width 42 of an intermediate space 12 between the tubes, the milling disk 22 cannot touch the outer circumference of a heating tube 2 in the event of a milling head 15 being tilted laterally (see FIG. 6).

Figure 7:
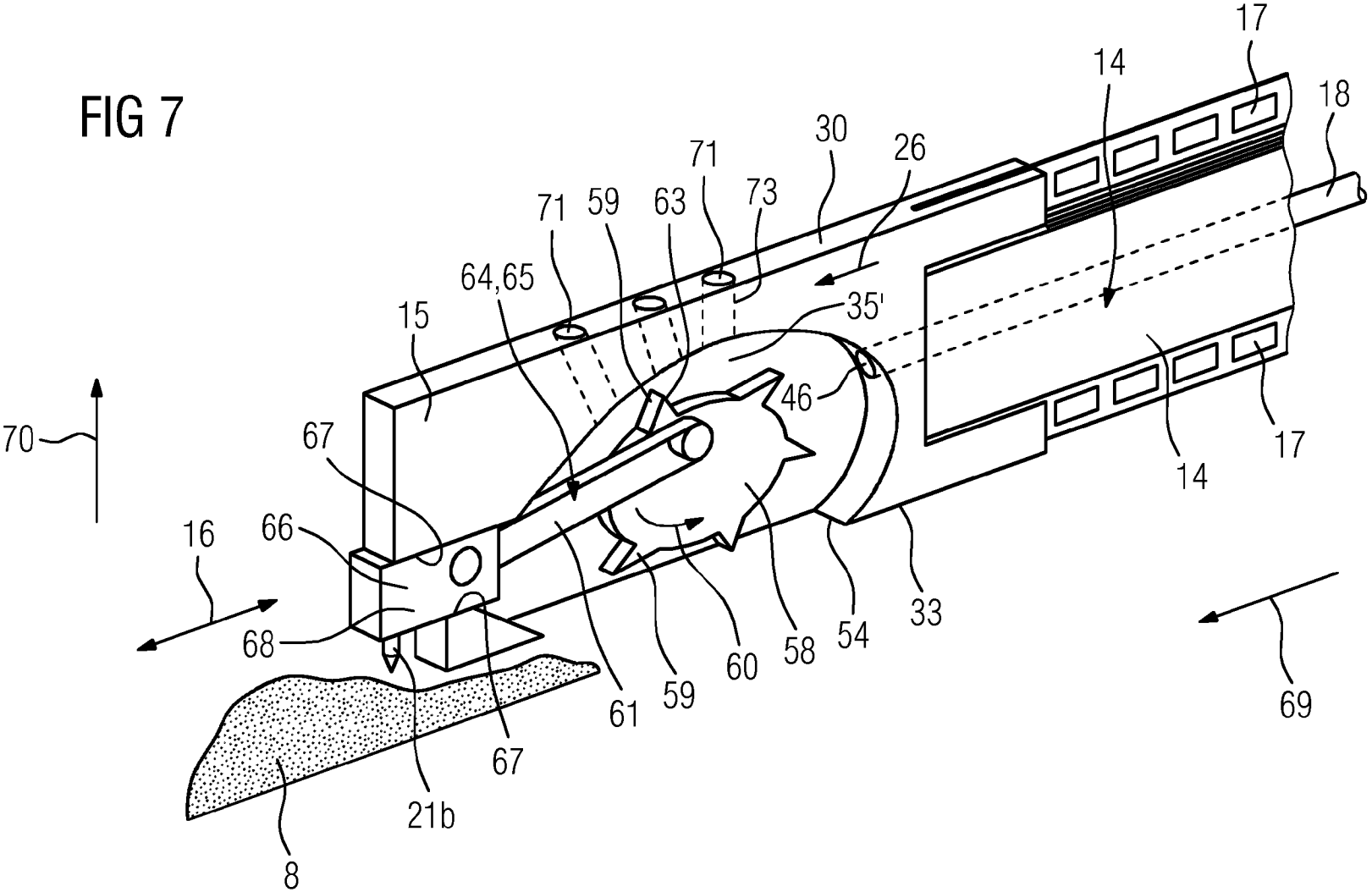
FIG. 7 shows, in a perspective illustration, the front end of a lance according to a second variant embodiment, wherein the cleaning head is open laterally in order to open up the view to the interior thereof.

FIG. 7 illustrates a second variant embodiment of a lance 13. In contrast to the exemplary embodiment described further above, there is a tool 21*b* here which is not directly driven by a flow of water supply to the cleaning head 15. The drive takes place via a water wheel 58 which is completely arranged in a cavity 35' arranged within the cleaning head 15. The cavity 35' is connected to the atmosphere via an outlet opening 54. The lance 13 comprises one or more water hoses 18, wherein just one water hose 18 is illustrated in FIG. 7. The water hose 18 opens by means of a nozzle opening 46 into the cavity 35. The nozzle arrangement 46 is arranged and oriented in such a manner that a flow of water or a water jet leaving said nozzle opening strikes against the water wheel 58 in the tangential direction 26. Said water wheel, for the rotational actuation thereof, has driving elements 59 which protrude from the circumferential surface thereof, interact with the flow of water and are, for example, of zigzag design. Surface elements of the driving elements 59 facing counter to the direction of rotation 60 of the water wheel 58 form impact surfaces 63 which are acted upon by the flow of water.

The movement of the water wheel 58 in the direction of rotation 60 is converted via a gear mechanism 64, namely a crank mechanism 65, into a linear movement extending in the direction of the longitudinal direction 16 of the lance 13. The crank mechanism 65 comprises a connecting rod 61, one end of which is coupled to the water wheel 58 and the other end of which is coupled to a support 66. The support 66 is mounted on the cleaning head 15 in such a manner that said support executes a movement extending in the longitudinal direction 16.

The cavity 35' opens on a working side 33 of the cleaning head 15 by means of an outlet opening 54 into the environment. Since the water wheel 58 is completely arranged within the cavity 35', the water wheel therefore does not protrude beyond the opening plane of the outlet opening 54 or beyond the working side 33 of the cleaning head 15.

The support 66 is guided in a guide channel 67 which is connected at one end thereof to the cavity 35' and the other end of which opens on the end side of the cleaning head 15 into the atmosphere. The tool 21*b* is fixed to a section 68 of the support 66 that projects from the cleaning head 15. The tool 21*b* is designed in the form of a scraping tool, namely as a pin extending toward the working side 33. The tool 21*b* protrudes from that side of the support 68 which faces the working side 33 only to the extent that said tool does not protrude over the working side 33.

In the case of the variant embodiment of a lance 13 being discussed, the tool 21*b* is located, as seen in the advancing direction 69 of the lance 13, in front of the region of action of a flow of water leaving the cavity 35' via the outlet opening 54. Said flow of water serves primarily here for washing away deposit particles removed by the scraping tool 21*b*.

Figure 8:
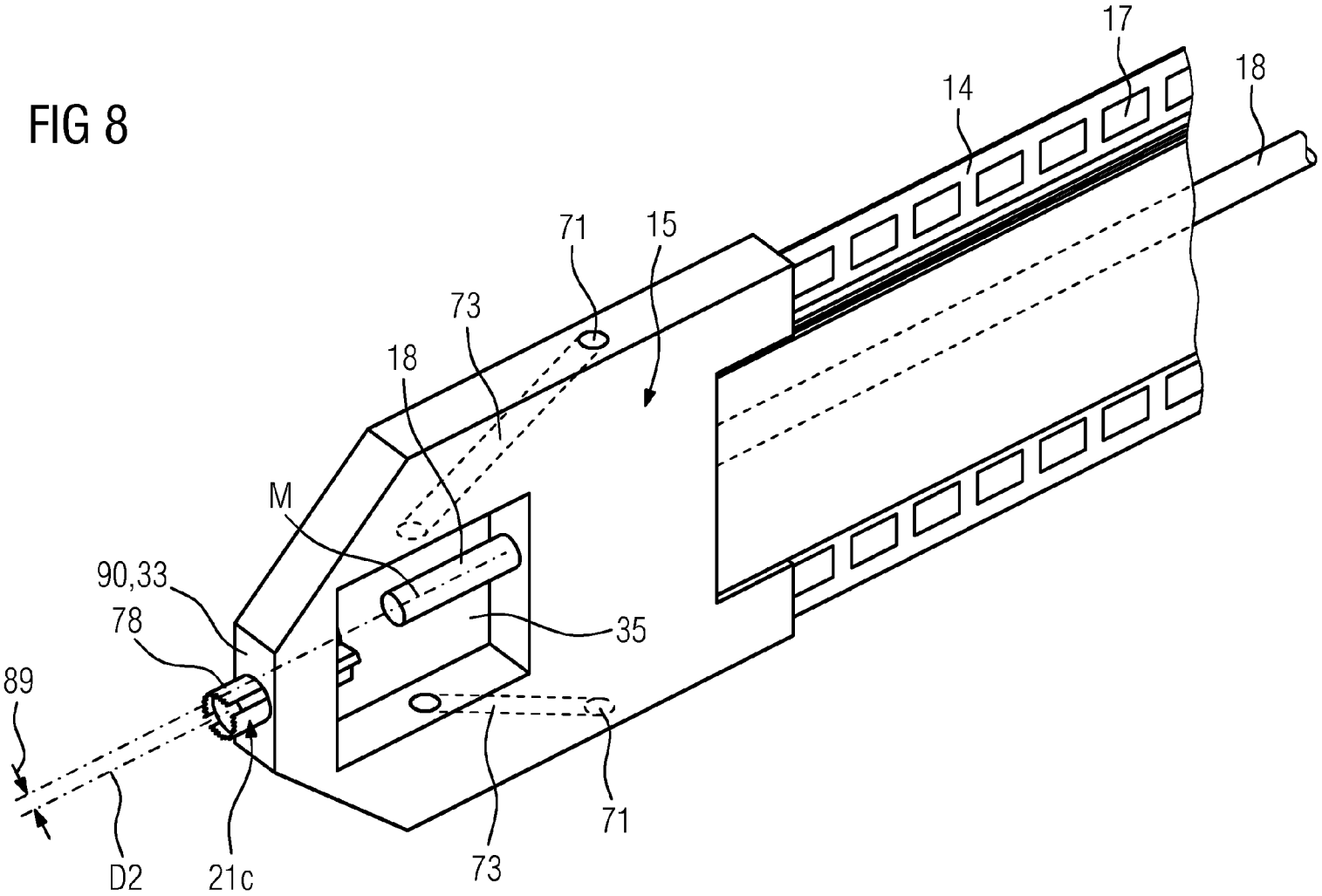
FIG. 8 shows, in a perspective illustration, the front end of a lance according to a third variant embodiment, wherein the cleaning head is open laterally in order to open up the view to the interior thereof.
Figure 9:
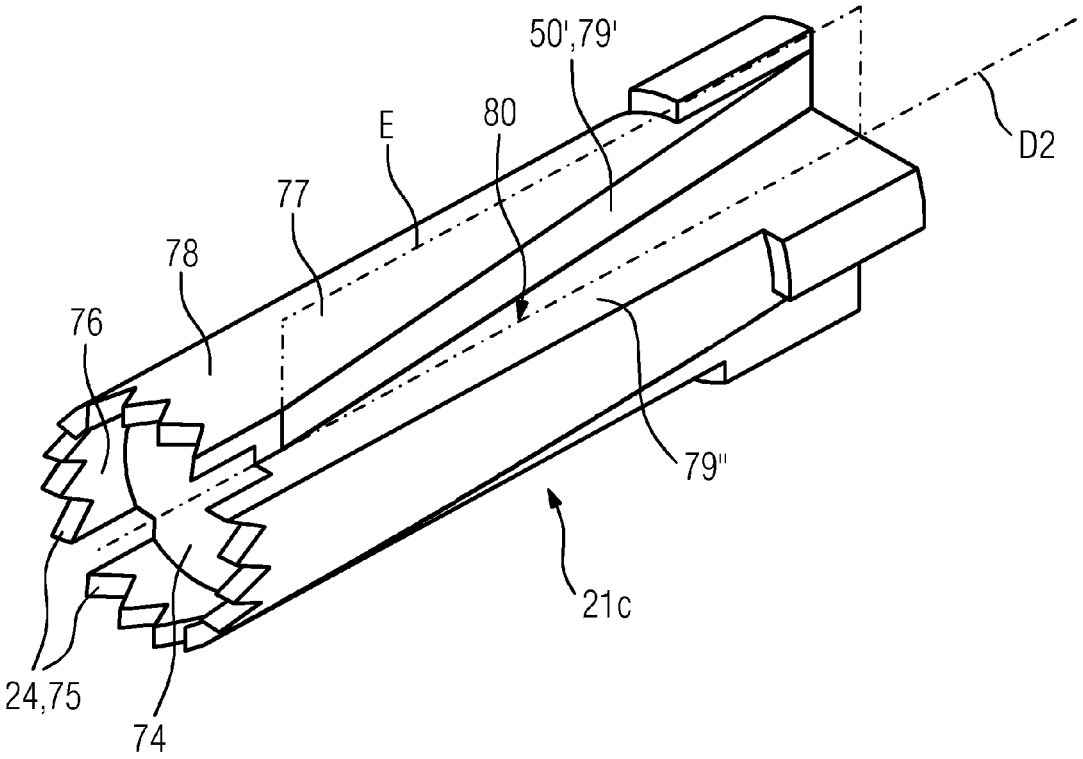
FIG. 9 shows a perspective illustration of the tool of the lance from FIG. 8.
Figure 10:
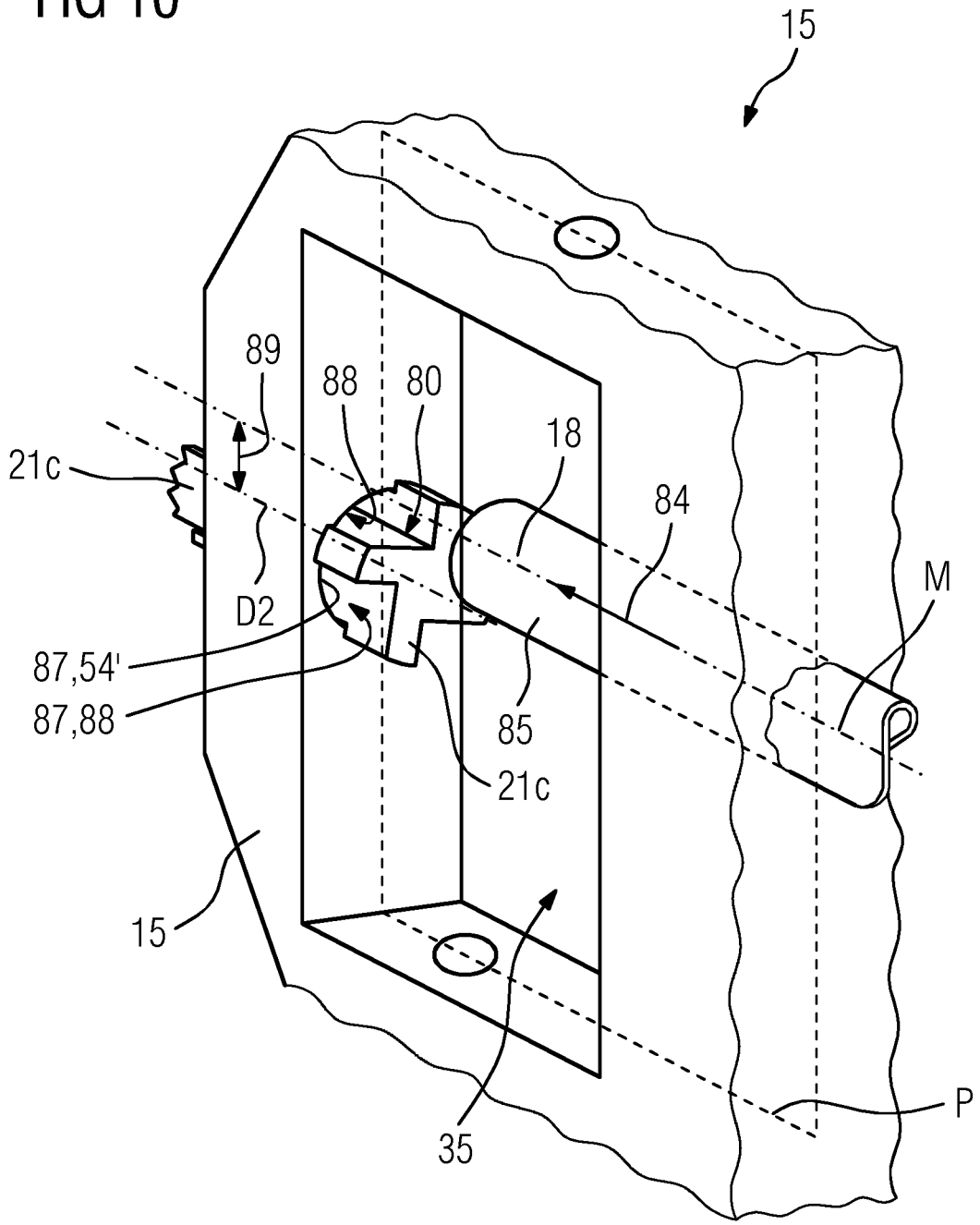
FIG. 10 shows a perspective illustration of an enlarged cutout of the cleaning head of the lance from FIG. 8.

FIGS. 8 to 10 show a variant embodiment which likewise has a rotating tool 21*c*, but wherein the axis of rotation D2 of which runs parallel to the central flat plane P of the cleaning head 15. The tool 21*c* is of substantially cylindrical configuration, approximately in the manner of a square bit. A drill collar 76 which is provided with teeth 75 protrudes axially from the front end surface 74 of said tool, i.e. the end surface which faces away from the flexible strip 14. The outer side of the drill collar 76 is aligned with the circumferential surface 77 of the tool 21*c*. Material-removing elements 24 in the form of the teeth 75 are therefore present on a surface extending transversely with respect to the axis of rotation D2, namely the end surface 74. However, material-removing elements 24, for example corundum grains or the like (not illustrated), can also be present, in addition to or instead of end-side material-removing elements 24, on the circumferential surface 77 of the tool 21*c*, specifically, on the front longitudinal section 78 of the tool 21*c*.

The tool 21*c* has a total of four impact surfaces 50' which are distributed uniformly in the circumferential direction and run substantially in the longitudinal direction of the tool 21*c* and obliquely with respect to a plane E containing the axis of rotation D2. The impact surfaces 50' are in each case formed by a groove wall 79' of flow grooves 80 introduced into the circumferential surface 77 of the tool 21*c*. In the exemplary embodiment shown, the groove wall 79' forming the impact surface 50' and the other groove wall 79" in each case are oriented at right angles to each other, i.e. enclose a right angle. Of course, other angles between the groove walls or other groove shapes are also conceivable. The second groove wall 79" in each case runs parallel to the axis of rotation D2 or to the plane E. The flow groove is therefore contracted toward the front end of the tool 21.

A cavity 83 into which a water hose 18 opens is arranged within the cleaning head 15. The tool 21*c* is arranged in such a manner that the flow grooves 80 are oriented parallel to the direction of flow 84 of a flow of water emerging from the water hose 18 or to the central longitudinal axis of the water hose 18. In the example shown in FIG. 10, the water hose 18 extends with a longitudinal section 85 into the interior, as a result of which the mouth opening of the water hose is brought relatively close to the rear end side 86 of the tool 21*c*.

The tool 21*c* is mounted rotatably about the axis of rotation D2 in an outlet opening 54' of the cleaning head 15, which outlet opening is designed as a bore 87, wherein the circumferential surface 77 and the ball bore interacts in the manner of a plain bearing. The ball wall and the groove wall 79', 79" together form a flow channel 88 which is contracted toward the front end of the tool 21*c* and through which water flows during the operation of the lance. The rotational speed of the tool 21*c* can be adjusted by means of the water pressure. So that a flow of water emerging from the water hose 18 can enter substantially without obstruction into a flow channel 88, there is an axial offset 89 between the axis of rotation D2 and the central longitudinal axis M of the water hose 18 and of the longitudinal section 85.

The flow grooves 80 and the flow channels 88 open into the front longitudinal section 78 of the tool 21*c*, which longitudinal section projects from a front end surface 90 of the cleaning head 15, which end surface runs transversely with respect to the axis of rotation D2. The front end surface 90 here forms the working side 33 of the cleaning head 15. Such an arrangement is suitable particularly for removing solid deposits in the intermediate spaces 12 between the tubes. During the material-removing machining, a pulsating water jet assisting the removal of material emerges from the flow channels 88. The water jet is pulsated by the fact that the flow of water leaving the water hose 18 is interrupted when said flow of water strikes against a surface region of the rear end side 86 of the tool 21*c*.

A lance 13 at the present time is inherently relatively stiff as regards a deflection in the vertical direction, corresponding to the arrow 70, because of the strip-shaped configuration of said lance, and therefore the lance 13 or the cleaning head 15 can be held on the tube sheet 4 by a force acting counter to the arrow direction 70 during the removal of deposits 8. However, this is frequently no longer sufficiently possible in particular if the lance has been retracted relatively far into the steam generator 1. In order to ensure an improved pressing of the cleaning head against the tube sheet 4, the cleaning head has one or more outlet bores 73 through which a partial flow of the flow of water supplied to the cleaning head 15 via the water hose 18 can be conducted away into the environment. The at least one outlet bore 73 is connected at one end thereof to the cavity 35 or 35' and opens at the other end thereof via an opening 71 on the outer side of the cleaning head 15 into the environment or into the interior of the steam generator 1.

The opening 71 in the outlet bore 73 can be arranged on the cleaning head 15 in such a manner that a flow of water emerging from said opening generates a recoil which at least partially compensates from the recoil which is caused by a flow of water emerging from the outlet opening 54. In the event of a correspondingly strong flow of water, the cleaning head 15 is pressed against the tube sheet 4. In the exemplary embodiment of FIGS. 2 to 6, the outlet bores 73 open by means of the openings 71 on the upper side 30, which is opposite the working side 33, of the cleaning head 15 into the environment. The consequence is a recoil acting counter to the arrow direction 70. In the exemplary embodiment shown in FIGS. 8 to 10, two outlet bores 73 extend obliquely with respect to the central longitudinal axis M of the cleaning head 15 or of the lance 13, wherein said outlet bores enclose an acute angle opening with respect to the flexible strip. Owing to this arrangement, a recoil which runs parallel to the central longitudinal axis M and is directed toward the drill collar 76 can be generated.

The invention claimed is:

1. A lance for removing deposits adhering to a tube sheet of a steam generator comprising: a flexible strip sized to be introduced into intermediate spacers between tubes of the steam generator, bears a cleaning head at a free end thereof and comprises at least one water hose for supplying a flow of water to the cleaning head, wherein the cleaning head comprises a working side which, in the use situation, faces the tube sheet or deposits present thereon, an outlet opening which is fluidically connected to the water hose and opens into the working side and a mechanical tool which acts on the deposits and removes material;

wherein:

the lance is characterized by a moveable tool driven by a drive; and the tool is driven directly by the flow of water or indirectly driven by the flow of water.

2. The lance as claimed in claim 1, characterized in that the cleaning head has a cavity into which the water hose opens and which is connected to the environment via the outlet opening.

3. The lance as claimed in claim 2, characterized in that the tool is at least partially arranged within the cavity present in the cleaning head.

4. The lance as claimed in claim 3, characterized in that a part of the tool that acts in a material-removing manner projects out of the outlet opening.

5. The lance as claimed in claim 4, characterized by a water wheel which is driven by the flow of water and is connected via a gear mechanism to the tool.

6. The lance as claimed in claim 5, characterized by a linearly movable tool which is connected to the water wheel via a crank mechanism.

7. The lance as claimed in claim 6, characterized in that the linear movement of the tool extends in the longitudinal direction of the lance.

8. The lance as claimed in claim 5, characterized in that the water wheel is oriented in such a manner that it is acted upon in the tangential direction at least by a partial flow of the flow of water.

9. The lance as claimed in claim 5, characterized in that the water wheel is at least partially arranged within the cavity present in the cleaning head.

10. The lance as claimed in claim 4, characterized in that the tool is fixed to a linearly movable support.

11. The lance as claimed in claim 10, characterized in that the support is guided in a guide channel which is connected to the cavity and opens into the environment, wherein the tool is arranged on a section of the support, which section projects out of the cleaning head.

12. The lance as claimed in claim 11, characterized in that the tool extends away from the support in the direction of the working side of the cleaning head.

13. The lance as claimed in claim 4, characterized in that the tool is a scraping tool.

14. The lance as claimed in claim 2, characterized in that the cleaning head comprises at least one outlet bore through which a partial flow of the flow of water supplied to the cleaning head via the water hose is conducted away into the environment.

15. The lance as claimed in claim 14, characterized in that the outlet bore is fluidically connected at one end thereof to the cavity and leads at the other end thereof via an opening into the environment.

16. The lance as claimed in claim 14, characterized in that the opening is arranged on the cleaning head in such a manner that a flow of water emerging from said opening produces a recoil which at least partially compensates for the recoil which is caused by a flow of water emerging from the outlet opening.

17. The lance as claimed in claim 1, characterized by a rotating tool.

18. The lance as claimed in claim 17, characterized in that the axis of rotation of the tool runs transversely with respect to a central flat plane of the cleaning head.

19. The lance as claimed in claim 18, characterized in that the tool has, with the drive thereof, impact surfaces which can be acted upon by the flow of water.

20. The lance as claimed in claim 19, characterized in that the tool is a rotating milling disk over a circumferential surface of which a multiplicity of material-removing elements is distributed.

21. The lance as claimed in claim 20, characterized in that the impact surfaces are present on the material-removing elements.

22. The lance as claimed in claim 20, characterized in that the milling disk is designed as a gearwheel, wherein teeth of which form the material-removing elements.

23. The lance as claimed in claim 20, characterized in that the milling disk is oriented in such a manner that it is acted upon in the tangential direction at least by a partial flow of the flow of water.

24. The lance as claimed in claim 1, characterized in that the axis of rotation of the tool runs parallel to the central flat plane of the cleaning head.

25. The lance as claimed in claim 24, characterized in that material-removing elements are present on a surface of the tool, which surface runs transversely with respect to the axis of rotation.

26. The lance as claimed in claim 24, characterized in that material-removing elements are present on a circumferential surface of the tool, which circumferential surface runs in the direction of rotation.

27. The lance as claimed in claim 24, characterized in that the tool has, for the drive thereof, at least one impact surface which can be acted upon by the flow of water.

28. The lance as claimed in claim 27, characterized in that the at least one impact surface runs substantially along the axis of rotation and obliquely with respect to a plane containing the axis of rotation.

29. The lance as claimed in claim 28, characterized in that the tool has a circumferential surface running coaxially with respect to the axis of rotation, wherein the at least one impact surface is formed by a groove wall of a flow groove introduced into the circumference surface.

30. The lance as claimed in claim 29, characterized in that the flow groove is contracted in the direction of flow of the flow of water.

31. The lance as claimed in claim 29, characterized in that the tool is mounted rotatably in the outlet opening of the cleaning head, which outlet opening is designed as a bore.

32. The lance as claimed in claim 1, characterized in that the tool does not protrude beyond the working side of the cleaning head.

* * * * *